US007123139B2

(12) United States Patent
Sweeney

(10) Patent No.: US 7,123,139 B2
(45) Date of Patent: Oct. 17, 2006

(54) WIRELESS INTEGRATED OCCUPANCY SENSOR

(75) Inventor: Kevin Sweeney, Andover, MA (US)

(73) Assignee: Tac AB, Malmo (SE)

( * ) Notice: Subject to any disclaimer, the term of this patent is extended or adjusted under 35 U.S.C. 154(b) by 0 days.

(21) Appl. No.: 11/136,879

(22) Filed: May 25, 2005

(65) Prior Publication Data

US 2005/0264414 A1 Dec. 1, 2005

Related U.S. Application Data

(60) Provisional application No. 60/574,198, filed on May 25, 2004.

(51) Int. Cl.
*G08B 19/00* (2006.01)

(52) U.S. Cl. ..... 340/521; 340/693.5; 340/547; 340/567; 340/539.1

(58) Field of Classification Search ..... None
See application file for complete search history.

(56) References Cited

U.S. PATENT DOCUMENTS 4,319,228 A * 3/1982 Daniels ..... 340/521
4,590,460 A * 5/1986 Abbott et al. ..... 340/541
5,268,670 A * 12/1993 Brasch et al. ..... 340/541
5,311,168 A * 5/1994 Pease et al. ..... 340/542
5,670,940 A * 9/1997 Holcomb et al. ..... 340/543
5,936,522 A * 8/1999 Vogt ..... 340/545.1
6,720,874 B1 * 4/2004 Fufido et al. ..... 340/541
7,026,932 B1 * 4/2006 Loudon ..... 340/568.1

OTHER PUBLICATIONS

Energy Eye Products Save Energy by Controlling your Hotel HVAC and PTAC, http://www.energy-eye.com/, May 16, 2005, pp. 1-2.
Energy Eye Products Save Energy by Controlling your Hotel HVAC and PTAC, http://www.energy-eye.com/about-energyeye.htm, May 16, 2005, pp. 1-2.
Energy Eye System Kit Saves Energy by Controlling your Hotel HVAC and PTAC, http://www.energy-eye.com/energy-system.htm, May 16, 2005, pp. 1-4.
A hotel can save energy by intalling Energy Eye guestroom management systems that con . . . , http://www.energy-eye.com/wasted-energy-costs.htm, May 16, 2005, pp. 1-2.
Examples of Where Energy Eye™ Components are located in a typical Hotel Guestroom, http://www.energy-eye.com/roomlayout.htm, May 16, 2005, pp. 1-2.
Energy Eye frequently asked questions, http://www.energy-eye..com/Hotel-Energy-FAQ.htm, May 16, 2005, pp. 1-3.
Energy Eye Installation Pictures!, http://www.energy-eye.com/installpics.htm, May 16, 2005, pp. 1-3.
Contact Energy Eye for Energy Saving, http://www.energy.-eye.com/contact-us.htm. . . , May 16, 2005, pp. 1-2.
Energy management systems and solutions for hoteliers, http://www.inncomm.com, May 13, 2005, pp. 1-2.

(Continued)

*Primary Examiner*—Benjamin C. Lee
(74) *Attorney, Agent, or Firm*—Paul C. Remus; Devine, Millimet & Branch

(57) ABSTRACT

An occupancy sensor is provided for determining whether a room is occupied. The occupancy sensor integrates a battery-powered PIR motion detector and a battery-powered Hall Effect switch, each of which communicates wirelessly with a controller, in a single housing.

6 Claims, 4 Drawing Sheets

OTHER PUBLICATIONS

Energy management systems and solutions, http://www.inncom.com/cfm/systems.cfm/sys_ID/5, May 13, 2005.
Smart Digital Thermostat, http://www.inncom/com/cfm/systems.cfm/prod_id/4/sys_id/2, May 13, 2005.
Smart Digital Thermostat, Energy Management Solutions, Inncom International, Inc., pp. 1-2.
Energy Management Systems and Solutions, http://www.inncom.com/cfm/systems.cfm/sys_ID/2, May 13, 2005, pp. 1-2.

* cited by examiner

WIRELESS INTEGRATED OCCUPANCY SENSOR

CROSS-REFERENCE TO RELATED APPLICATIONS

The present application claims the benefit of application Ser. No. 60/574,198 filed May 25, 2004, which is incorporated herein by reference.

TECHNICAL FIELD

The present application relates to an occupancy sensor for a room and, in particular, to an occupancy sensor that integrates a passive infrared ("PIR") motion detector and a magnetic door switch in one wireless, battery-powered unit.

BACKGROUND OF THE INVENTION

Many building owners, including the owners of apartments, offices and hotels, continue to seek methods to decrease their heating, ventilating and cooling ("HVAC") expenses. One method to do so is to select minimum and maximum setback temperatures for a room, which require less operation of the room's HVAC equipment, when the room is not occupied. This method requires an accurate occupancy sensor for the room.

In the past, motion detectors have been used as occupancy sensors. In particular, PIR motion detectors have been used. A PIR motion detector typically measures persons or objects that are both 1) showing a selected surface temperature difference from that of the room and 2) moving at a selected speed. For example, a PIR motion detector that measures 1) surface temperature differences of at least ±2° C. and motion of at least 10 cm/sec is commercially available from Bircher America, Inc.

However, the use of a PIR motion detector as an occupancy sensor does not produce an accurate indication of a room being occupied in situations in which an occupant remains motionless for an extended period of time, such as in sleeping, reading or watching television. The PIR motion detector is also not accurate in rooms in which the geometry of the room includes blind spots to the PIR motion detector such as alcoves or bathrooms.

The accuracy of occupancy information can be improved by using both a PIR motion detector and a magnetic door switch, which provides status information as to whether the access door to a room is open or closed. If the PIR motion detector detects motion in the room just after the access door has been opened and closed, it is safe to assume that the room is occupied until the door opens again regardless of whether further motion is detected. Conversely, if the PIR motion detector does not detect motion in the room just after the door has been opened and closed, it is safe to assume that the room is unoccupied until the door opens again. Typically, such magnetic door switches have been Hall Effect switches, the operations of which are well known to those skilled in the art. In operation, the Hall Effect switch is mounted on a door frame and a small magnet is mounted on the door so that it is in proximity to the Hall Effect switch when the door is closed.

In the past, when used together, a PIR motion detector and a magnetic door switch were either wired together, or were each separately wired to a controller, to communicate both information and power. This wiring is in many cases prohibitively expensive. As a result, more recently, occupancy sensing has been done through the use of a PIR detector and a magnetic door switch, in which one element was wired to a controller and the other element communicated information wirelessly to the controller. For example, Inncom International produces an e4 Smart Digital Thermostat that includes a PIR motion detector wired to the thermostat controlling a room's HVAC equipment and a magnetic door switch that wirelessly communicates information to the thermostat. This method mitigates, but does not completely solve, the cost of the additional wiring to install apparatus. It also does not address the case in which an individual thermostat is not needed in each room.

Another more recent method of occupancy sensing involves the use of a PIR motion detector and a magnetic door switch, which are separate units and each of which is battery operated and wirelessly communicates information. For example, Energy Eye, Inc. produces an Energy Eye system for occupancy sensing comprising two separate components: a PIR motion detector and a magnetic door switch, each of which communicates information wirelessly with a controller. The PIR motion detector is powered by a CR123A lithium camera type battery, with an expected battery life of two years, and the magnetic door switch is powered by a CR2450 lithium coin cell battery, with an expected battery life of five years. The stated advantage of this system is that because the components are separate, if one is damaged or breaks, the whole system does not need to be replaced. However, the separate components may be more noticeable to occupants of the room, and this system requires installation of multiple components in each room, and the changing of different types of batteries in the different components at different intervals, increasing expenses.

What is needed is an occupancy sensor that integrates a PIR motion detector and magnetic door switch, each of which wirelessly communicates information to a controller, and both of which are battery operated and located in a single housing. What is further needed is a single power source for the integrated PIR motion detector and magnetic door switch such that the single power source is one or more batteries of the same type located in the single housing.

SUMMARY OF THE INVENTION

The present invention is a wireless integrated occupancy sensor for determining whether an enclosed space, such as a room, is occupied. The occupancy sensor integrates a battery-powered PIR motion detector and a battery-powered Hall Effect switch, each of which communicates wirelessly with a controller, in a single housing. The housing also contains a single power source of one or more batteries of the same type.

These aspects of the present invention are not meant to be exclusive and other features, aspects, and advantages of the present invention will be readily apparent to those of ordinary skill in the art when read in conjunction with the following description, appended claims, and accompanying drawings.

BRIEF DESCRIPTION OF THE DRAWINGS

These and other features and advantages of the present invention will be better understood by reading the following detailed description, taken together with the drawings wherein.

DETAILED DESCRIPTION OF THE INVENTION

The present invention is a battery-powered, wireless integrated occupancy sensor. In one embodiment, it is a small battery operated sensor to be used to determine if a controlled space, such as a room, is occupied. It will be used in conjunction with a fixed algorithm or programmable processor used as the controller of HVAC equipment, with which it will be in wireless communication, that needs occupancy information to optimize energy use in HVAC operations.

Figure 1:
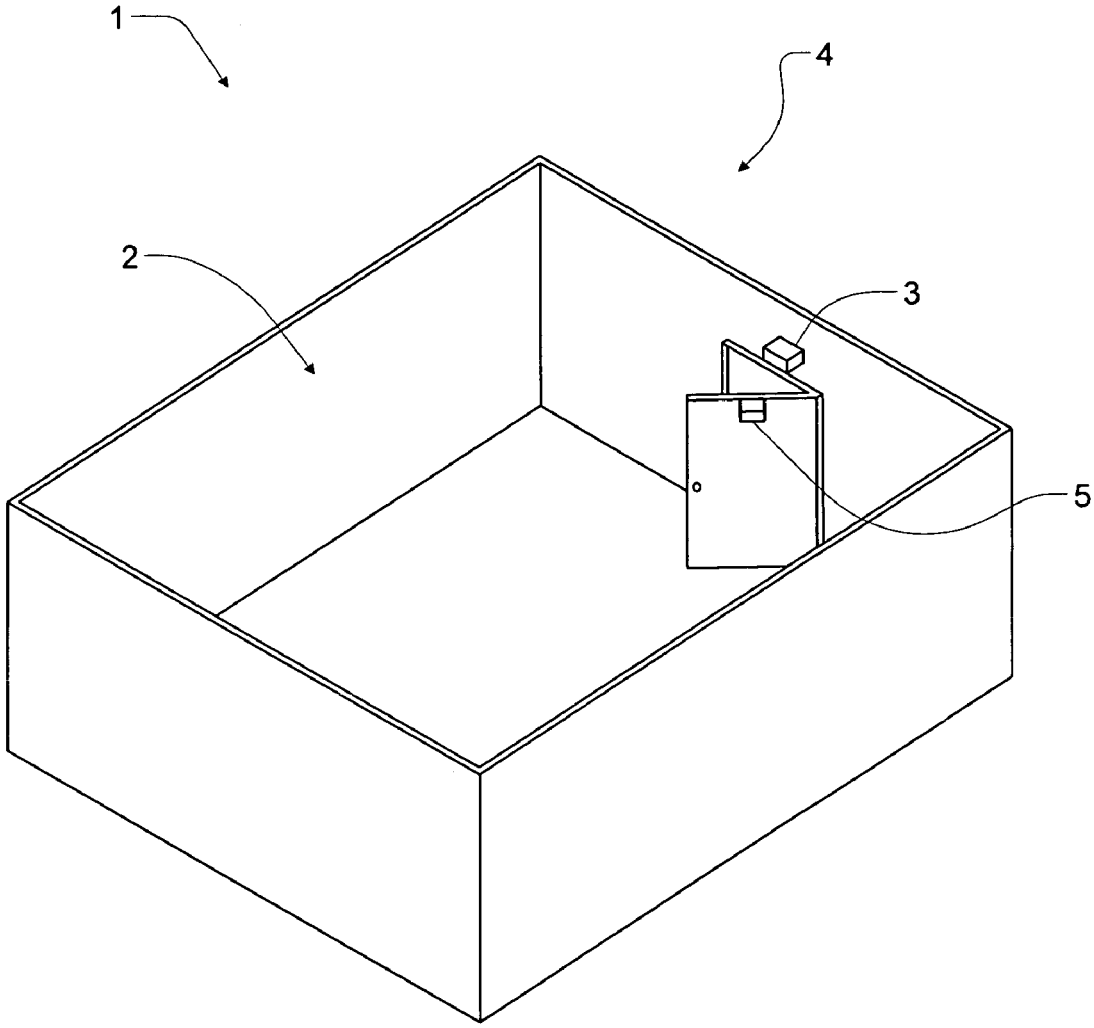
FIG. 1 is a diagram of a room showing the location of an embodiment of a wireless integrated occupancy sensor.
Figure 2:
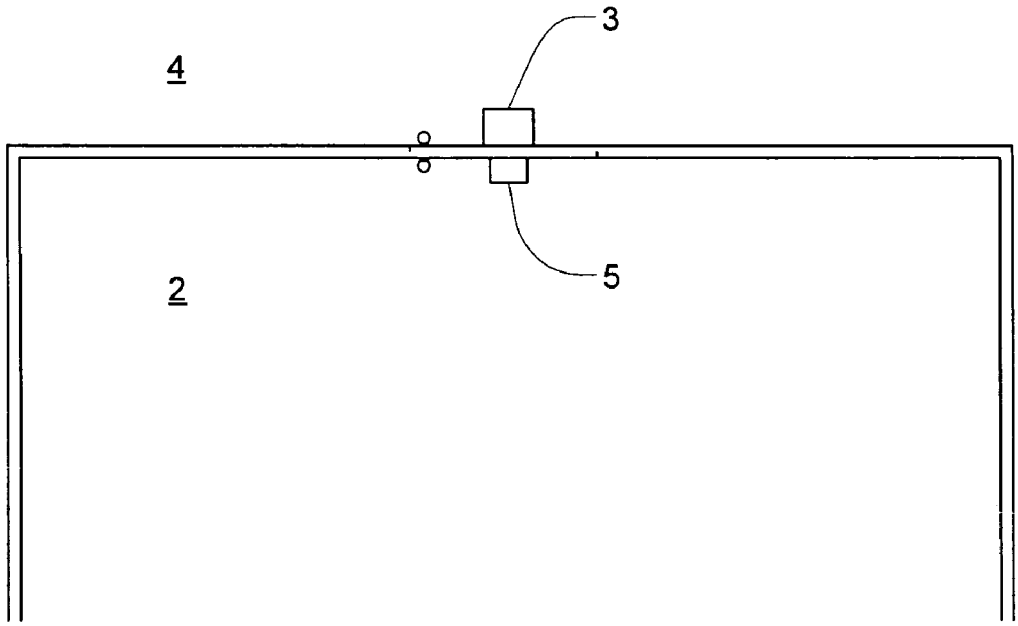
FIG. 2 is a diagram of a door and its frame showing the location of an embodiment of a wireless integrated occupancy sensor.

In one embodiment, as shown in FIG. 1, occupancy information is sought for a controlled space such as a room 1, with access door 2. The occupancy sensor 3 of the present invention is mounted on the door frame 4 holding door 2. A small magnet 5 is mounted on door 2 in proximity to the occupancy sensor 3 when door 2 is shut. A closer view of the door 2 and door frame 4 is shown in FIG. 2, which also shows the occupancy sensor 3 mounted on the door frame 4 and the small magnet 5 mounted on the door 2.

Figure 3:
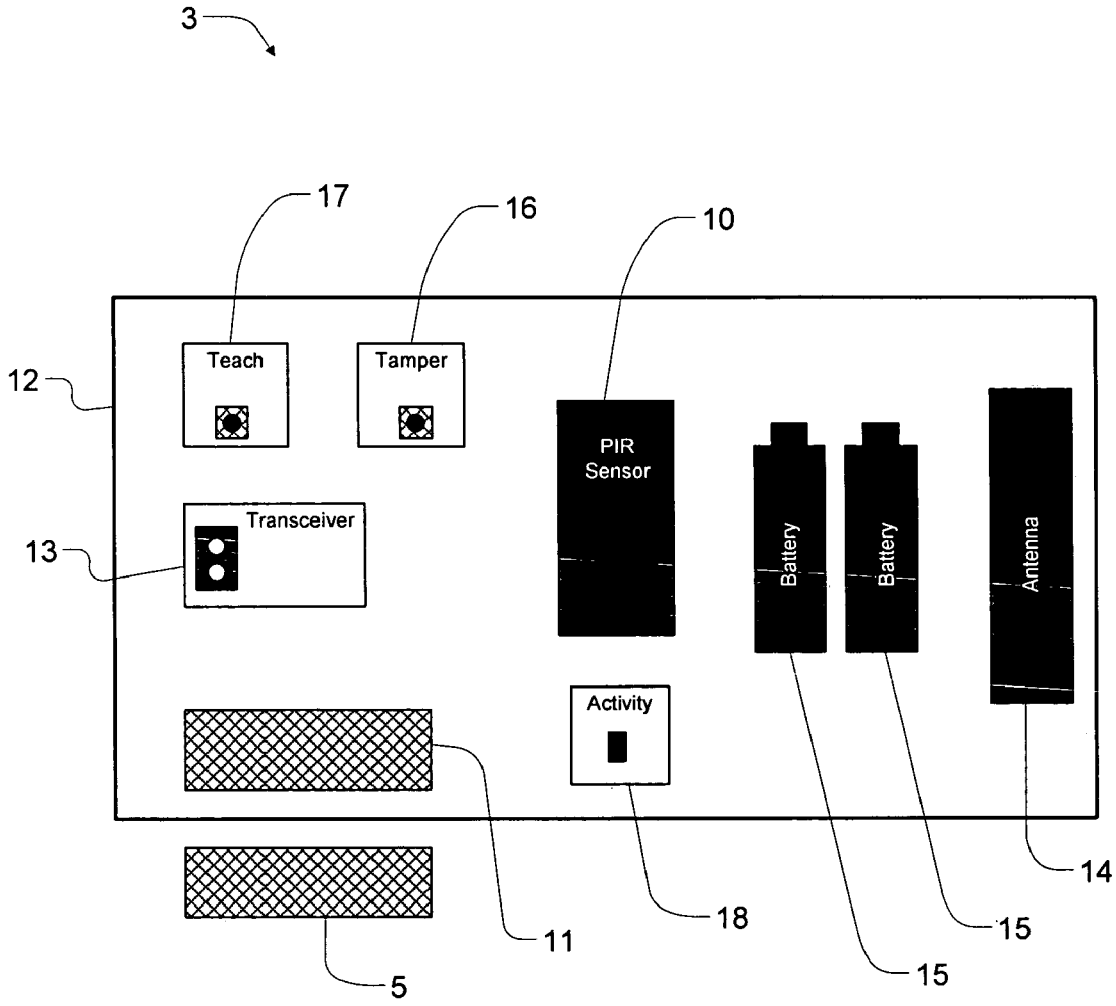
FIG. 3 is a schematic diagram of the components of an embodiment of a wireless integrated occupancy sensor

Another embodiment of the current invention is shown in more detail in FIG. 3. The occupancy sensor 3 includes a battery-powered PIR motion detector 10 and a battery-powered magnetic door switch, in particular a Hall Effect switch 11, in a single housing 12. The PIR motion detector 10 detects a person or object whose temperature varies from that of the room by more than a selected number of ° C. and moves at a speed faster than a selected number of cm/sec. The Hall Effect switch detects whether the door is open or closed. The housing 12 is a plastic injection molded enclosure of the smallest possible size that is adequate for having the requisite electronics and is mountable on the horizontal trim molding of a door. The housing 12 is a neutral off-white color suitable for a variety of interior decors.

Figure 4:
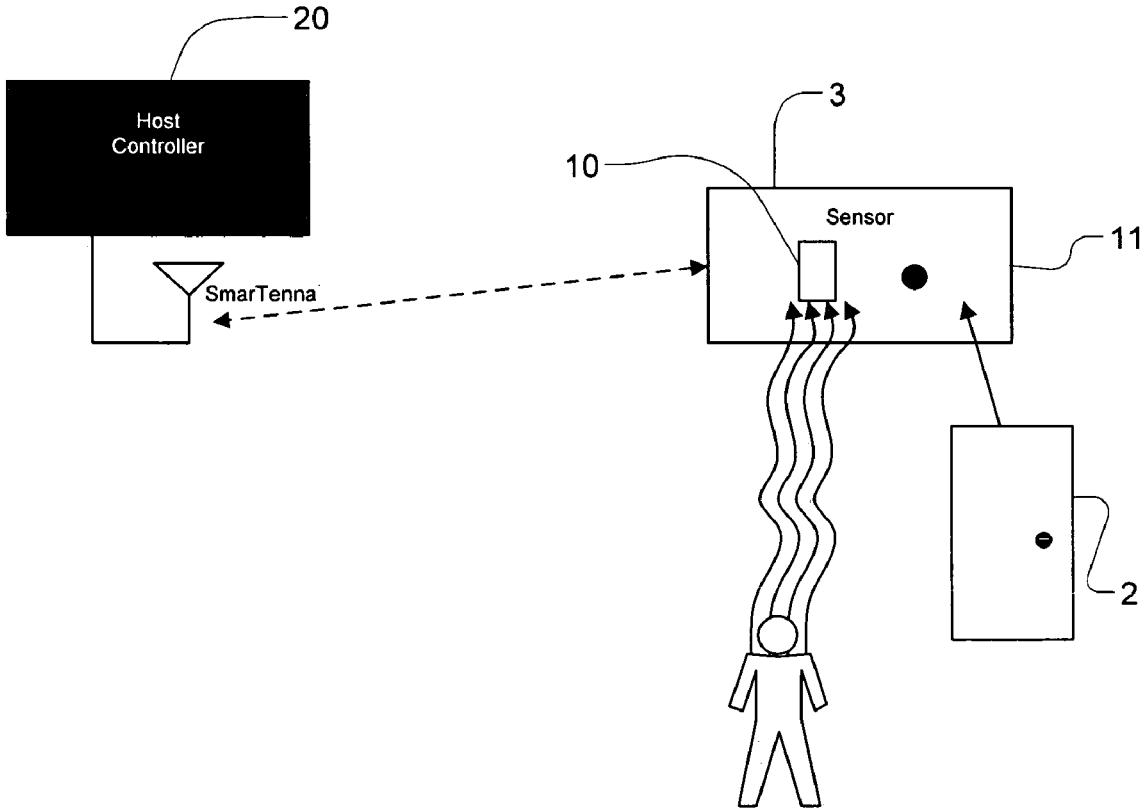
FIG. 4 is a schematic diagram of the operation of a wireless integrated embodiment of a wireless integrated occupancy sensor.

The housing 12 also contains a wireless IEEE 802.15.4 compatible transceiver 13 and antenna 14 for sending wireless messages to a controller, controlling HVAC operations for the room. In operation, as shown in FIG. 4., the occupancy sensor 3 wirelessly sends a communication status message to the controller 20 every 5 minutes when the occupancy sensor is active indicating it is active. The occupancy sensor 3 also wirelessly communicates status messages, both motion status messages and door status messages, to the controller 20. The Hall Effect switch 11 causes a door closed status message to be sent when the door 2 is closed and a door open status message to be sent when the door 2 is open. The PIR motion detector causes a motion detected message to be sent when it detects motion. If the PIR motion detector 10 detects motion in the room 1 just after the door 2 has been opened and closed, it is assumed that the room 1 is occupied until the door 2 opens and closes again, regardless of whether further motion is detected. Conversely, if the PIR motion detector 10 does not detect motion in the room just after the door 2 has been opened and closed, it is assumed that the room 1 is not occupied until the door 2 again opens and closes.

Referring again to the embodiment shown is FIG. 3, the housing 12 contains one or more batteries 15 of the same type, in this embodiment AA batteries, to power the components of the occupancy sensor 3. The occupancy sensor 3 wirelessly sends a battery low message to the host controller 20 when there is less than 20 percent battery capacity remaining. Changing the batteries 15 will clear the battery low message. Batteries 15 are easily changed without tools. Any information necessary for maintaining communications with the controller 20 is retained in non-volatile memory of the occupancy sensor 3 so as to persist through battery changes.

The housing 12 also contains a cover and a tamper switch 16 that is activated upon removal of the cover to the housing 12. The tamper switch 16 when activated causes a tamper detected message to be sent wirelessly to the host controller 20 and a tamper cleared message to be sent wirelessly when the cover is replaced.

The housing 12 also contains a teach button 17 that causes a message to be sent wirelessly to the controller 20 that contains sufficient identifying information to allow the controller 20 to associate with it whenever the teach button 17 is depressed. The housing 12 also contains a LED activity status indicator 18. The LED indicator 18 turns on for 0.5 seconds whenever motion or a change in door status is detected. This is primarily to facilitate installation and troubleshooting. The LED status indicator is then disabled via a wireless command message from the controller 20 once the installation process is complete in order to save battery power.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein.

Modifications and substitutions by one of ordinary skill in the art are considered to be within the scope of the present invention, which is not to be limited except by the following claims.

The invention claimed is:

1. An occupancy sensor for detecting occupancy of a room with an access door comprising:

a battery-powered passive infrared motion detector for producing a motion detected status message;

a battery-powered Hall Effect switch for producing a door open or door closed status message; and a battery-powered transceiver for wirelessly transmitting motion detected, door open and door closed status messages;

wherein the motion detector, the Hall Effect switch and the transceiver are all contained in a single housing.

2. The occupancy sensor of claim 1 further comprising one or more batteries of the same type contained in the single housing to act as a power source for the motion detector, the Hall Effect switch and the transceiver.

3. The occupancy sensor of claim 2 wherein the occupancy sensor wirelessly transmits a low battery status message when the one or more batteries have less than 20 percent battery capacity remaining.

4. The occupancy sensor of claim 3 further comprising one or more batteries of the same type contained in the single housing to act as a power source for the motion detector and the Hall Effect switch.

5. The occupancy sensor of claim 1 further comprising a cover to the single housing and a tamper switch that causes a tamper detected status message to be sent when the cover is removed from the single housing.

6. An occupancy sensor for detecting occupancy of a room with an access door comprising:

a battery-powered passive infrared motion detector for detecting motion within the room;

a battery-powered Hall Effect switch for detecting whether the door is open or closed;

wherein the motion detector and the Hall Effect switch are each in wireless communication with a controller and are both contained in a single housing.

* * * * *